United States Patent [19]

Asai et al.

[11] Patent Number: 4,628,891

[45] Date of Patent: Dec. 16, 1986

[54] MAGNETO-GENERATOR FOR INTERNAL COMBUSTION ENGINE

[75] Inventors: Masahiro Asai, Hekinan; Yasuhiro Hikimoto, Anjo, both of Japan

[73] Assignee: Nippondenso Co., Ltd., Kariya, Japan

[21] Appl. No.: 699,956

[22] Filed: Feb. 8, 1985

[30] Foreign Application Priority Data

Feb. 15, 1984 [JP] Japan ..... 59-27946
Mar. 27, 1984 [JP] Japan ..... 59-60136
Sep. 27, 1984 [JP] Japan ..... 59-203391

[51] Int. Cl.[4] ..... F02P 1/00

[52] U.S. Cl. ..... 123/599; 123/149 C; 123/149 D; 310/70 R; 310/156

[58] Field of Search ..... 123/599, 594, 406, 414, 123/601, 602, 149 C, 149 D; 310/153, 74, 154, 156, 70 R

[56] References Cited

U.S. PATENT DOCUMENTS 2,843,769 7/1958 McGrery ..... 123/149 D
3,732,483 5/1973 Katsumata ..... 123/149 C
3,741,186 6/1973 Doi et al. ..... 123/599
3,947,710 3/1976 Miyamoto ..... 123/149 D
3,955,550 5/1976 Carlsson ..... 123/599
4,137,884 2/1979 Odazima et al. ..... 123/149 D
4,160,435 7/1979 Sleder ..... 123/149 D
4,423,345 12/1983 Nilsson ..... 123/149 D
4,564,776 1/1986 Tomite et al. ..... 123/149 D

FOREIGN PATENT DOCUMENTS 725623 9/1942 Fed. Rep. of Germany ... 123/149 D

*Primary Examiner*—Raymond A. Nelli
*Attorney, Agent, or Firm*—Cushman, Darby & Cushman

[57] ABSTRACT

A signal generator is located substantially in a center position within an iron cup opposingly to the fore end of a crankshaft, and a timing portion is provided on the inner periphery of the iron cup in a position opposing the signal generator, permitting to dispose the signal generator within the iron cup of a small diameter by effective use of the entire space of the iron cup without obstacled by the crankshaft.

22 Claims, 16 Drawing Figures

MAGNETO-GENERATOR FOR INTERNAL COMBUSTION ENGINE

BACKGROUND OF THE INVENTION

1. Field of the Invention

This invention relates to a magneto-generator which is driven by an internal combustion engine.

2. Brief Description of Prior Art

As disclosed in Japanese Laid-Open Utility Model Application No. 55-53973, magneto-generators of this sort are generally constructed in such a manner as to accommodate within an iron cup rotor a stator core mounting power-generating coil windings and a signal generator.

However, in order to obtain large output by such a magneto-generator construction, a larger stator core with the power-generating coil windings has to be located within the iron cup rotor, which is therefore required to be of a larger size, resulting in an unduly large construction as a whole.

On the other hand, as proposed in Japanese Utility Model Publication No. 35-8321 and German Patent No. 885180, it is known to locate a stator core with power-generating coil winding on the outer side of a rotor. In magneto-generator constructions of this type, a crankshaft of an internal combustion engine is extended through a rotor, and a signal generator which is located in an axially protruded position relative to the rotor is operated by the crankshaft portion which is projected out of the rotor. Accordingly, the magneto-generators have a large axial length and lack compactness.

Further, Japanese Utility Model Publication No. 58-5094 proposes an arrangement in which a signal generator is positioned opposingly to a projection provided on the outer periphery of an iron cup, or alternatively a signal generator is formed integrally with a stator core at a position opposing the outer periphery of a crankshaft.

In a case where a signal generator is located on the outer periphery of an iron cup, however, it becomes necessary to provide an additional space for the signal generator at the sacrifice of compactness in construction. Where a signal generator is located in vis-a-vis relation with the outer periphery of a crankshaft by the use of the space between an iron cup and the crankshaft by the use of the space between an iron cup and the crankshaft, the shapes of the stator core and signal generator are restricted to certain designs.

SUMMARY OF THE INVENTION

It is therefore an object of the present invention to provide a magneto-generator which is small in size and weight as a whole.

It is another object of the invention to facilitate the job of assembling a rotor with a crankshaft.

It is still another object of the invention to eliminate the relative limitations in shape of the stator core and signal generator.

A further object of the invention is to block rotation of a magnet in a secure manner without increasing the number of parts.

A still further object of the invention is to provide suitable protection for the magnet.

According to one aspect of the invention, there is provided a magneto-generator, comprising: an iron cup mounted on a crankshaft of an internal combustion engine for rotation therewith, the open end of the iron cup being faced outward or in a direction away from the crankshaft; a permanent magnet mounted on the outer periphery of the iron cup for rotation therewith; a stator core located in a position opposing the permanent magnet; a power-generating coil supported on the stator core; a signal generator located substantially at a center position within the iron cup and having at least one part thereof disposed opposingly to the fore end of the crankshaft; and a timing portion provided on the inner periphery of the iron cup at a position opposing the signal generator.

The above and other object, features and advantages of the invention will become more apparent from the following description and appended claims, taken in conjunction with the accompanying drawings which show by way of example some preferred embodiments of the invention.

DETAILED DESCRIPTION OF PREFERRED EMBODIMENTS

Figure 1:
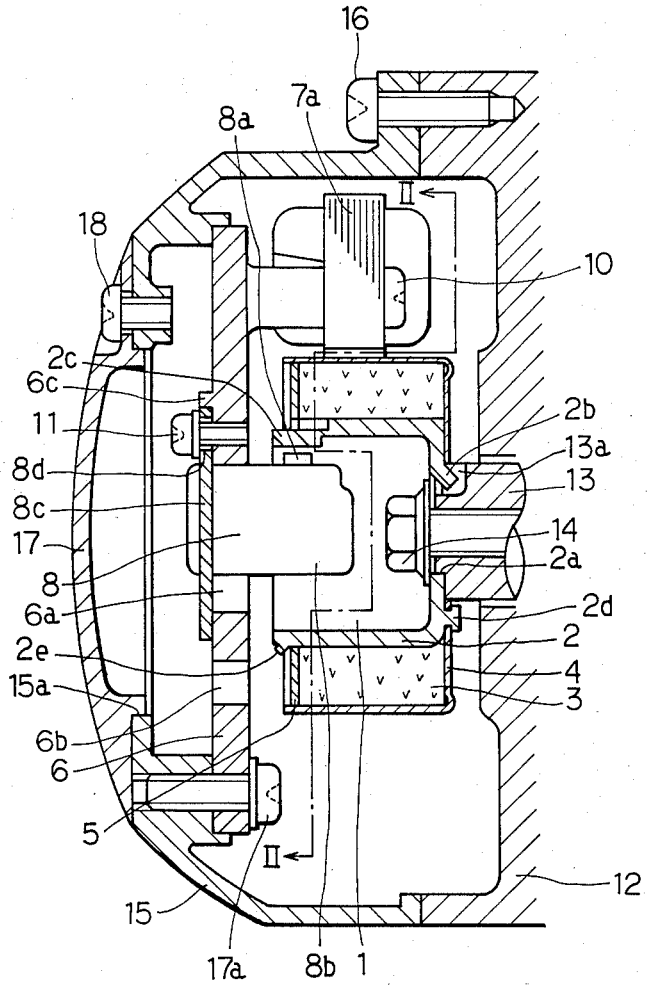
FIG. 1 is a cross-sectional view taken on line I—I of FIG. 3, showing a construction of the magneto-generator according to a first embodiment of the present invention.
Figure 2:
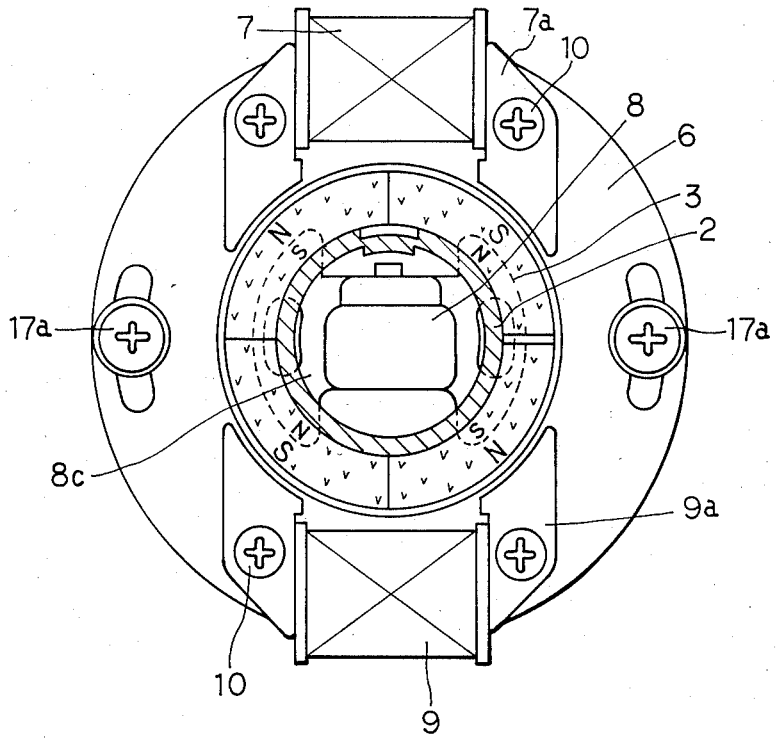
FIG. 2 is a cross-sectional view taken on line II—II of FIG. 1.

Now, the invention is described more particularly by way of some preferred embodiments shown in the drawings. Referring first to FIGS. 1 to 5, there is shown a first embodiment of the invention, wherein indicated at 1 is a rotor which is constituted by an iron cup 2, a plurality of permanent magnets 3, a protection cover 4 for the magnets 3, and a plate 5.

A hole 2*a* is provided centrally on the bottom surface of the iron cup 2 for attaching a crankshaft 13 of an internal combustion engine thereto. Part of the marginal edge portion of the hole 2*a* is cut out to form a positioning tab 2*b* which is bent or raised toward the crankshaft 13 to play a role similar to the conventional key. A projection 2*c* for the timing signal is formed by embossing in a semicircle-like form on the inner periphery of the cylindrical body of the iron cup.

A plural number of permanent magnets 3 (four magnets in the particular example shown) are arranged in a ring form around the outer periphery of the iron cup 2, and protected on all sides by a cup-like cover 4 of a thin non-magnetic material which covers the outer periphery and one side of the magnets 3 and by an annular plate 5 of a non-magnetic material (e.g., stainless steel, aluminum or brass) which covers the other side of the magnets 3. These plate 5 and cover 4 may be formed of a magnetic iron sheet if its thickness is small, or may be dispensed with in a case where the surfaces of the magnets 3 are coated with an adhesive or the like. The cover 4 is securely fixed to the outer bottom surface of the iron cup 2 by means of a columnar projection 2*d* which is embossed on the outer bottom surface of the iron cup 2 or by rivets.

On the other hand, the plate 5 is fixed in position by driving same into the outer periphery of the iron cup 2 or by deforming part of the outer peripheral wall of the iron cup 2 radially outward as indicated at 2*e*. Further, the iron cup 2, magnets 3 and cover 4 and plate 5 are bonded securely to each other by an adhesive.

The stator includes a disk-like base 6 mounting thereon a stator core 7*a* with a capacitor-charging coil winding 7, a signal generator 8 and a stator core 9*a* with a power-generating coil winding 9 for driving valves which adjust the extent of opening of intake and exhaust ports of an engine. The capacitor-charging coil 7 and the power-generating coil 9 for driving the valves are located in radially opposite positions on the front side of the base 6, while the signal generator 8 is mounted substantially at the center of the base 6. Designated at 10 are fastening screws which fix the respective cores 7*a* and 9*a* to the base 6, and at 11 is a screw which fixes the signal generator 8 to the base 6. The signal generator 8 includes a permanent magnet (not shown), a core 8*a* positioned in contact with one end of the just-mentioned magnet, a signal coil (not shown) fitted on; the outer periphery of the core 8*a*, a molded resin material 8*b* integrally embedding these component parts, and a mounting stay 8*c* which has one part integrally embedded in the bottom side of the molded resin 8*b*. The stay 8*c* is fixed to the rear side of the base 6 by a screw 11. A hole 6*a* is provided substantialy at the center of the base 6 for fixing the signal generator 8 in an inserted state. The signal generator 8 is positioned in the hole 6*a* at an end on the side of the stay 8*c* and protruded on the front side of the base 6 at an end away from the stay 8*c*, with the fore end of the core 8*a* projected in a radial direction from a lateral side of the protruded portion on the front side of the base 6.

Figure 4:
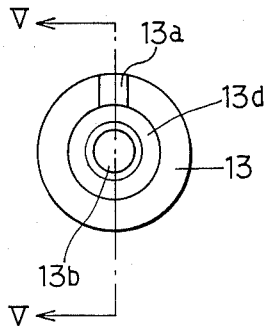
FIG. 4 is a schematic front view, showing the shape of the fore end of a crankshaft in the first embodiment.
Figure 5:
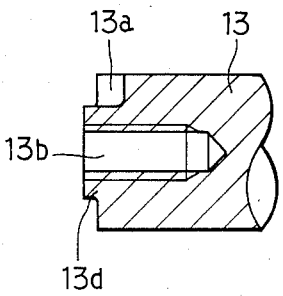
FIG. 5 is a cross-sectional view taken on line V—V of FIG. 4.

The stator cores 7*a* and 9*a* with the power-generating coil windings 7 and 9 are I-shaped and the pole pieces at the opposite ends are in the form of arcs facing toward the center side. Indicated at 12 is a side wall of the internal combustion engine, and at 13 is an engine crankshaft which has a diameter larger than that of the mounting hole 2*a* of the iron cup 2 and extended through the side wall 12. Denoted at 14 is a bolt for fixing the iron cup 2 directly to the crankshaft 13 with the open end of the iron cup 2 faced outward in a direction away from the crankshaft 13 as shown particularly in FIG. 1. The shaft 13 is provided with a positioning groove 13*a* on its end face as shown in FIGS. 4 and 5 for receiving and positioning tab 2*b* of the iron cup 2. In FIG. 4, the reference numeral 13*b* indicates a tapped hole into which the bolt 14 is screwed. The fore end portion of the crankshaft 13, which is inserted in a mounting hole 2*a* of the iron cup 2, is formed in a small-diameter portion 13*d* which has a diameter slightly smaller than that of the mounting hole 2*a* and axial dimensions smaller than the wall thickness of the iron cup 2. When the iron cup 2 is fixedly fastened to the crankshaft 13 by the bolt 14, the head (the hexagonal tightening portion) of the bolt 14 alone is projected on the inner bottom surface of the iron cup 2. Designated at 15 is a generator cover which is formed in a cup-like shape surrounding the rotor 1 and fixed to a side wall 12 of the internal combustion engine by screws 16. Further, the base 6 is fixed to the inner bottom surface of the cover 15 by screws 17*a*. Consequently, the pole pieces of the stator cores 7*a* and 9*a* with the power-generating coil windings 7 and 9 are disposed in small gap relation with the outer periphery of the permanent magnets 3, while the signal generator 8 is located face to face with respect to the fore ends of the crankshaft 13 and bolt 14, with the fore end of the core 8*a* of the signal generator 8 facing the timing projection 2*c* of the iron cup 2 in small gap relation therewith.

Further, the cover 15 is provided with an opening 15*a* in its bottom wall for the adjustment of ignition-spark timing, closed by a spark timing adjusting cover 17 which is attached to the generator cover 15 by screws 18. The holes 8*d* which receive the mounting screws 11 for the stay 8*c* of the signal generator 8 are formed in arcuate slots as shown particularly in FIG. 3 to permit adjustment of mounting positions of the signal generator 8 relative to the base 6. By loosening the screws 11 after detaching the spark timing adjusting cover 17, the mounting position of the signal generator 8 relative to the base 6 is adjustable in the circumferential direction (for adjustment of spark timing). The base 6 is provided with a peep window 6*b* in a portion opposing the plate 5 on the side of the rotor 1 so that a spark timing mark (not shown) on the plate 5 can be seen through the peep window 6*b*. Provided on the rear side of the base 6 are a pair of arcuate guide projections 6*c* which are formed arcuately along the outer configuration of the stay 8*c* of the signal generator 8 to facilitate the guide of the rotational position of the stay 8*c* relative to the base 6.

Figure 6:
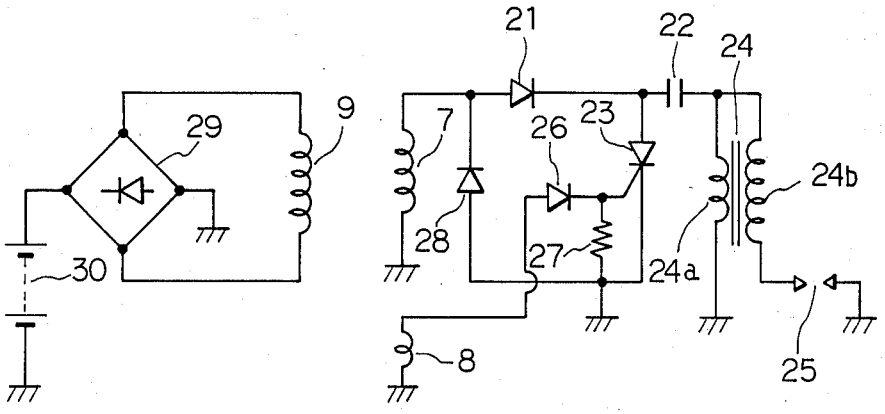
FIG. 6 is an electric circuit diagram showing an exemplary electric circuit to which the first embodiment is applicable.

Referring now to FIG. 6, there is shown an example of an electric circuit which is applicable of the magneto-generator of the above-described construction. As illustrated, one end of the capacitor-charging coil 7 is grounded, while the other end is connected to the anode of a diode 21. The cathode of the diode 21 is connected to one end of an ignition capacitor 22 and to the anode of an ignition thyristor 23. The other end of the capacitor 22 is grounded through a primary coil 24*a* of an ignition coil 24, and the cathode of the thyristor 23 is also grounded. One end of a secondary coil 24*b* of the ignition coil 24 is connected to a conjunction between the capacitor 22 and primary coil 24*a*, while the other end is grounded through an ignition spark plug 25. The signal generator 8 has one end of its signal coil grounded and the other end connected to the anode of a diode 26, the cathode of which is connected to the gate of the ignition thyristor 23. A resistor 27 is connected between the gate and cathode of the ignition thyristor 23, and a diode 28 is connected parallel with the terminals of the capacitor-charging coil 7.

On the other hand, the both ends of the valve drive power-generating coil 9 are connected to a battery 30 through a full-wave rectifier 29. Connected to the battery 30 is, for example, the load of lamps and valve drive motor which controls open areas of intake and exhaust ports of a 2-cycle engine and the like although not shown in the drawing.

In a case where the above-described magneto-generator has a rotor 1 of quadripole magnitization, for example, the interlinking magnetic flux from the magnets 3 is varied with rotation of the rotor 1 which is coupled with the crankshaft 13 of the internal combustion engine. As a result, two cycles of alternate voltage is produced in the valve drive power-generating coil 9 per revolution of the rotor 1, and one cycle of alternate voltage is produced in the signal generator 8 each time the timing signal projection 2*c* faces the core 8*c*.

Accordingly, the ignition capacitor 22 is charged through the diode 21 by positive half wave of the alternate voltage produced in the capacitor-charging coil 7, short-circuiting the negative half waves through the diode 28. A positive pulse which is produced in the signal generator 8 at the ignition point is applied between the gate and cathode of the ignition thyristor 23 through the diode 26, whereupon the ignition thyristor 23 becomes conductive and the electric charge of the ignition capacitor 22 is abruptly discharged to the primary coil 24*a* of the ignition coil 24, thereby producing a high voltage in the secondary coil 24*b* of the ignition coil 24 for supplying an ignition spark to the spark plug 25.

The output of the valve drive power-generating coil 9 serves as a power source for charging the battery 30 through a low-voltage power supply circuit or rectifier 29.

With the magneto-generator of the above-described construction, the iron cup 2 is fixedly fastened to the crankshaft 13 by the bolt 14, and the head of the bolt 14 alone is projected on the inner bottom surface of the iron cup 2. In addition, the signal generator 8 is positioned substantially at a center position within the iron cup 2 in face to face relation with the fore ends of the crankshaft 13 and its bolt 14, and the timing signal projection 2*c* is formed on the inner periphery of the iron cup 2 in a position opposing the fore end of the core 8*a* of the signal generator 8, effectively utilizing the whole space in the iron cup 2. Accordingly, it is possible to provide the signal generator 8 within an iron cup 2 of a relatively small diameter without obstacled by the crankshaft 13 or to reduce the size and weight of the rotor 1 if desired. Such an arrangement is advantageous particularly in a case where a rotor 1 with a relatively small moment of inertia is required. The use of a rotor 1 of a smaller diameter makes it possible to select the minimum necessary sizes for the magnets 3 to be mounted on the iron cup 2, the power-generating coils 7 and 9 and the cores 7*a* and 9 for these coils, permitting to construct the magneto-generator in an efficient and compact form as a whole.

Moreover, the stay 8*c* of the signal generator 8 is fixed to the rear side of the base 6 by screws 11, and the signal generator 8 is partly received in the hole 6*a* of the base 6 at an end on the side of the stay 8*c* and axially protruded into the iron cup 2 on the side of the base 6 at the end away from the stay 8*c*, utilizing the hole 6*a* of the base 6 as part of the space for accommodating the signal generator 8. Accordingly, it is possible to reduce the size of the magneto-generator as a whole effectively by employing an iron cup 2 of a small diameter as compared with the size of the signal generator 8.

Since the signal generator 8 is located substantially at a center position in the iron cup 2, the magnetic flux from the magnets 3 is blocked by the iron cup 2, and the leakage flux is unlikely to act on the signal generator 8 which is located at the center position. Therefore, the signal generator 8 is securely kept from the adverse effects of noise voltage resulting from the leakage flux. In addition, owing to reductions in size and weight of the rotor 1, the iron cup 2 of the rotor 1 can be directly mounted on the crankshaft 13 in a boss-less fashion (without boss having a tapered mounting hole), unnecessitating screw extraction from the rotor 1 or an extracting tool. As part of the iron cup 2 around the marginal edge of the mounting hole 13*b* of the crankshaft 13 is bent toward the latter, the rotor 1 can assembled in a facilitated manner by the use or a reduced number of parts, without resorting to key fitting.

Figure 7:
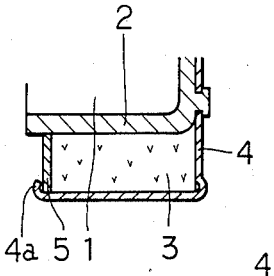
FIG. 7 is a schematic vertical section of a second embodiment of the magneto-generator according to the invention, showing major parts of the rotor.
Figure 8:
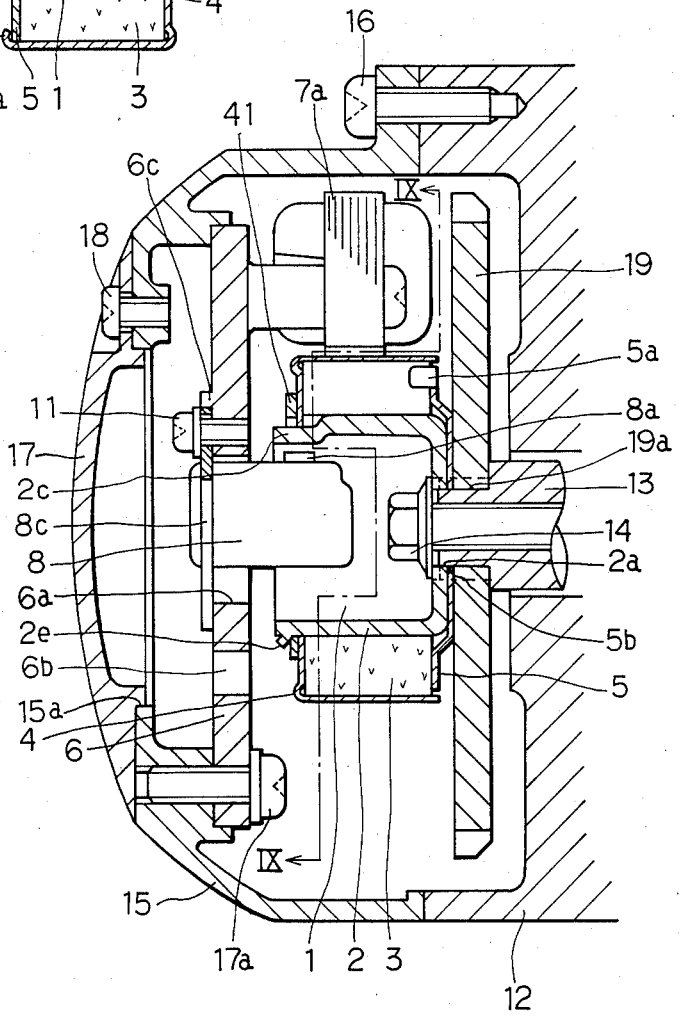
FIG. 8 is a cross-sectional view taken on line VIII—VIII of FIG. 9, showing a construction of the magneto-generator according to a third embodiment of the present invention.
Figure 10:
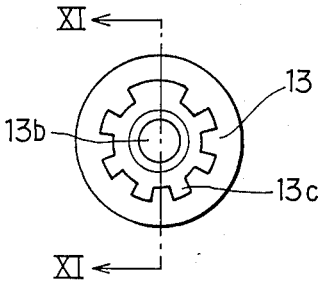
FIG. 10 is a schematic front view, showing the shape of the fore end of a crankshaft in the third embodiment.
Figure 11:
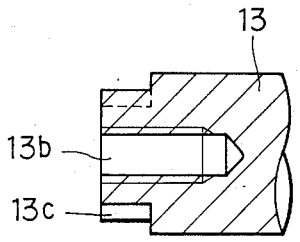
FIG. 11 is a cross-sectional view taken on line XI—XI of FIG. 10.
Figure 9:
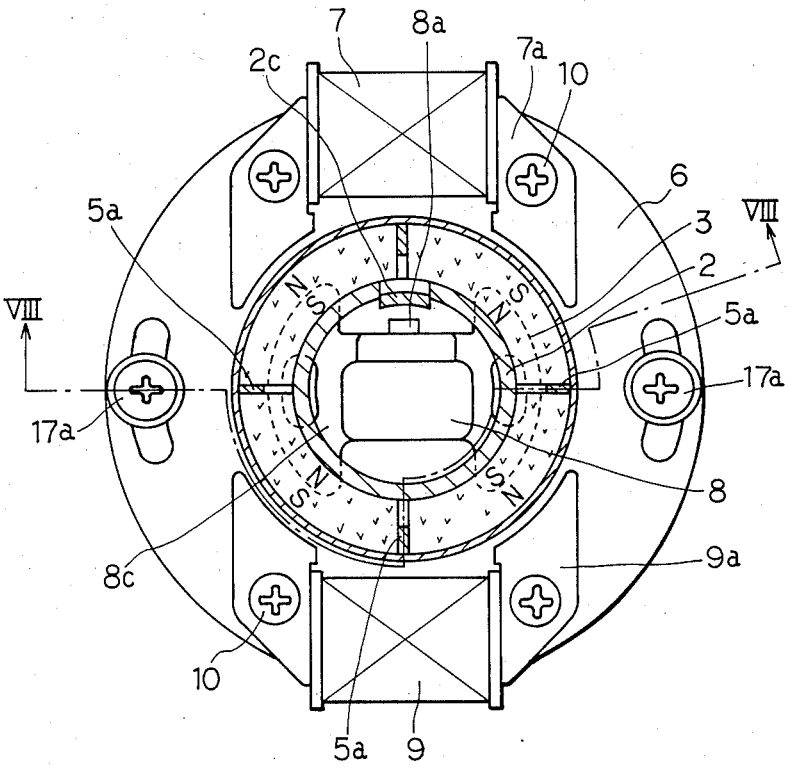
FIG. 9 is a cross-sectional view taken on line IX—IX of FIG. 8.

Illustrated in FIG. 7 are a rotor 1 and associated parts in a second embodiment of the invention, which differs from the foregoing first embodiment in that the open end of the magnet protection cover 4 is bent inward around the entire periphery thereof to prevent extraction of the plate 5 instead of deforming part of the outer peripheral wall at the open end of the iron cup 2 as indicated at 2*e*.

Referring to FIGS. 8 to 11, there is shown a third embodiment of the invention which differs from the first embodiment in that a spline 13*c* is cut into the outer periphery of the crankshaft 13 at the fore end thereof, forming part of the spline 13*c* ridges (or grooves) in a greater width than the others to serve as a positioning member for engagement in the hole 2*a* of the iron cup 2 which is formed in a similar spline 13*c* configuration (through slightly larger). Further, the center hole 19*a* of the ring gear 19 and the hole 5*b* in the plate 5 which is located on the outer bottom surface of the iron cup 2 are also formed in a spline configuration complementary to that of the crankshaft 13. (Alternatively, a flat portion may be provided on one part of the circular outer periphery of the crankshaft 13 at the fore end thereof, fittingly engaging it in center holes of a similar configuration which are formed in the iron cup 2, ring gear 19 and plate 5.) The spline 13*c* at the fore end of the crankshaft 13 is fitted in the ring gear 19, plate 5 and iron cup 2. Thereafter, the iron cup 2, plate 5 and ring gear 19 are fastened together by the bolt 14 and securely fixed to the crankshaft 13. In this instance, a gear portion which is formed on the outer periphery of the ring gear 19 is meshed with a pinion of a starter (not shown) for starting the internal combustion engine.

The plate 5 is provided with a folded portion 5*a* which blocks rotation of the magnets 3. As shown particularly in FIG. 9, the folded portion 5*a* is interposed between two adjacent magnets 3 to determine the position of the magnets 3 in the radial direction and to block the rotational movements thereof. The plate 5 which is required to have high mechanical strength than the cover 4 has a greater thickness. (e.g., the plate 5 has a wall thickness of about 0.4–1 mm as compared with the cover 4 with a thickness of about 0.3 mm.)

Part of the inner periphery of the cover 4 is fitted in an embossed sensor groove on the outer periphery of the iron cup 2 to block its rotation. A plate 41 serves as a washer for the protection of the cover 4 and fitted on the outer periphery of the open end of the iron cup 2 in contact with the bottom surface of the cover 4.

In a case where part of the magnet protection cover 4 is folded to determine the position of the magnets 3, the cover 4 is required to have a small thickness for the electric output in contradiction to the requirement that the folded portion for blocking rotation of the magnets 3 should have sufficient mechanical strength. In order to meet these requirements without increasing the number of parts, this employs an arrangement in which the plate 5 is provided with a bent portion 5*a* for blocking rotation of the magnets 3 and integrally fastened to the iron cup 2 to form part of a power transmission system, thereby guaranteeing the strength of the rotor 1 and using the cover 4 only for the purpose of protecting the magnets 3.

Figure 12:
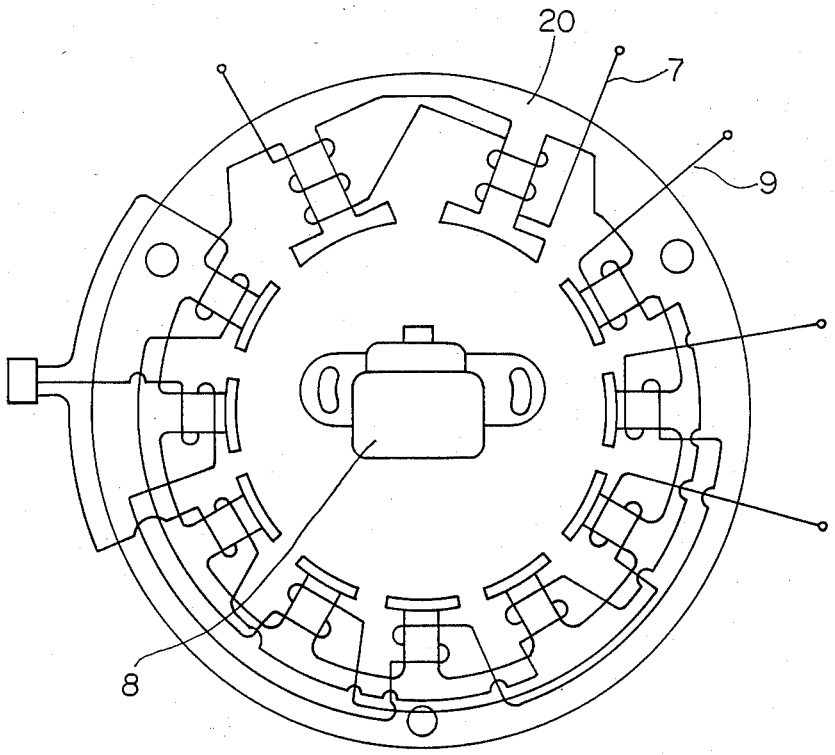
FIG. 12 is a schematic plan view, showing the construction of a stator in a fourth embodiment of the invention.

Illustrated in FIG. 12 is the construction on the side of the stator in a fourth embodiment of the invention, employing a ring-like core 20 with a plural number of pole projections which are extended radially inward, instead of the I-shaped stator cores 7*a* and 9*a* in the first and third embodiments. The stator core 20 has a capacitor-charging coil 7 wound on two pole projections in series, winding power-generating coils 9 for the load on the respective ones of the remaining pole projections. The pole projections on which the capacitor-charging coil 7 is formed in the same pitch as that of the magnetic poles of the rotor 1 (at the pitch of 45° in the case of an 8-pole rotor as in the particular example shown), and the remaining pole projections with the power-generating coils 9 are formed at intervals of ($\frac{2}{3}$) in terms of electric angle, which is smaller than the pitch of the magnetic poles of the rotor 1 (in a magnetic pole pitch of 30° in the particular example shown), to produce three-phase output in the power-generating coils 9 for the load.

Figure 13:
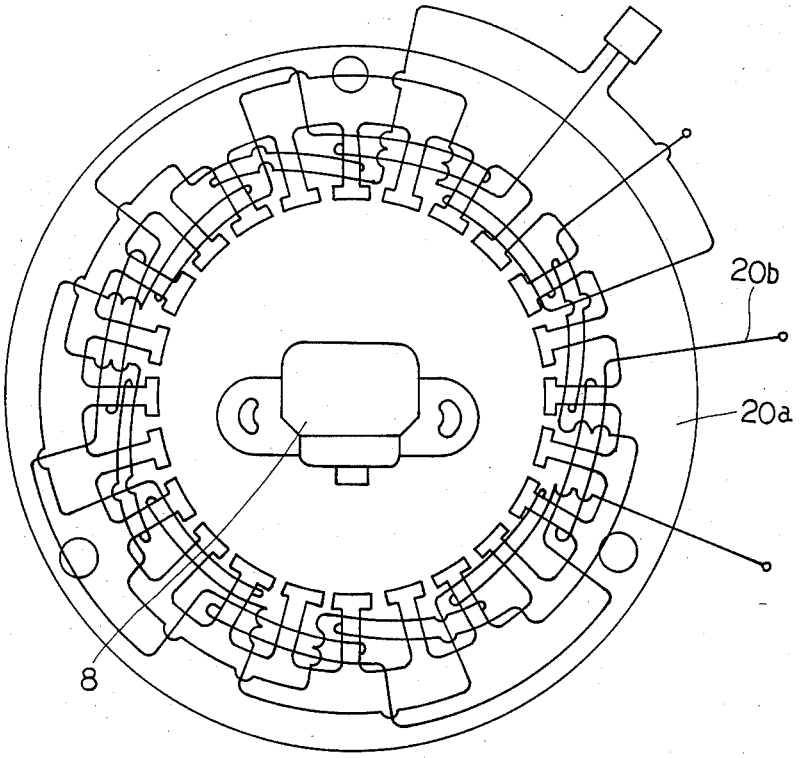
FIG. 13 is a schematic plan view, showing the construction of a stator in a fifth embodiment of the invention.

Illustrated in FIG. 13 is the construction on the side of the stator in a fifth embodiment of the invention, employing a ring-shaped stator core 20*a* which has a multitude of slots around the inner periphery thereof, fittingly mounting three-phase current-producing coils 20*b* in the respective slots by lap winding (or by wave winding).

In this embodiment, the output current of the three-phase power-generating coils 20*b* is charged in a battery after full wave rectification by a three-phase full wave rectifier, for supplying power to a current interrupting transistor type ignition system or other loads.

Figure 14:
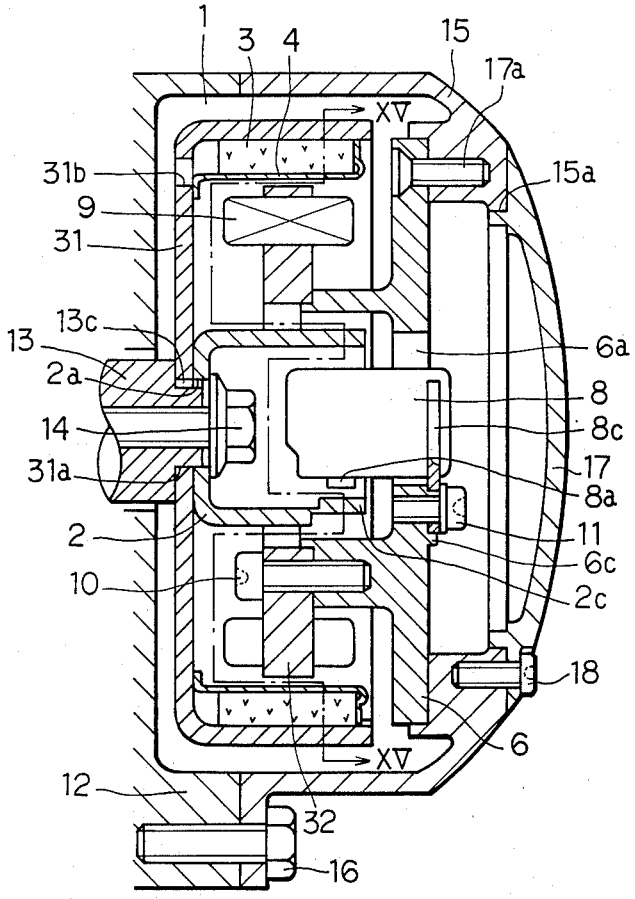
FIG. 14 is a cross-sectional view taken on line IXV—IXV of FIG. 15, showing a construction of the magneto-generator according to a sixth embodiment of the present invention.
Figure 15:
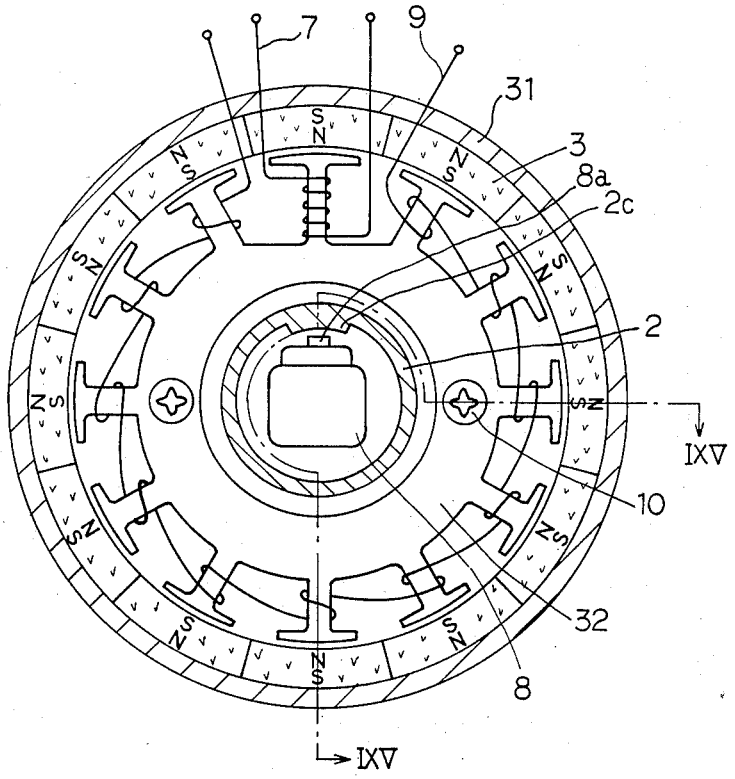
FIG. 15 is a cross-sectional view taken on line XV—XV of FIG. 14.

Referring to FIGS. 14 and 15, there is shown a sixth embodiment of the invention, wherein the spline 13*c* of the crankshaft 13 is fitted in a hole 2*a* of a second iron cup 2 and also in a hole 13*a* of a first iron cup 31 of a larger diameter than the second iron cup 2, and the first and second iron cups 31 and 2 are securely fixed to the crankshaft 13 by a bolt 14.

The permanent magnets 3 are arranged in a ring-like form around the inner periphery of the first iron cup 31 and protected on all sides of a thin magnet protection cover 4 which is pressed in to cover the inner peripheral and side surfaces of the permanent magnets 3. Further, the permanent magnets 3 and cover 4 are securely bonded to the first iron cup 31 by an adhesive which is injected through an adhesive injection hole 31*b* provided in the first iron cup 31. A stator core 32 which is formed of a laminated iron sheet is securely fixed to a stator base 6 between the inner periphery of the magnets 3 and the outer periphery of the second iron cup 2. The stator core 32 is in the form of a ring having a multitude of pole projections which are extended radially toward the outer periphery in small gap relation with the permanent magnets 3, winding a capacitor-charging coil 7 on one of the pole projections and power-generating coils 9 for the load on the remaining pole projections.

In a case where the magneto-generator of the above construction has twelve magnets 3 to be magnetized in a radial direction, for example, as the first iron cup 31 which is coupled with the crankshaft 13 of the internal combustion engine is rotated, the interlinking magnetic flux from the magnets 3 is varied, producing 6 cycles of alternate voltage in the capacitor-charging coil 7 and power-generating coils 9 per revolution of the first iron cup 31. On the other hand, the one cycle of alternate voltage is generated in the signal generator 8 when the timing signal projection 2*c* faces the core 8*a*.

Figure 16:
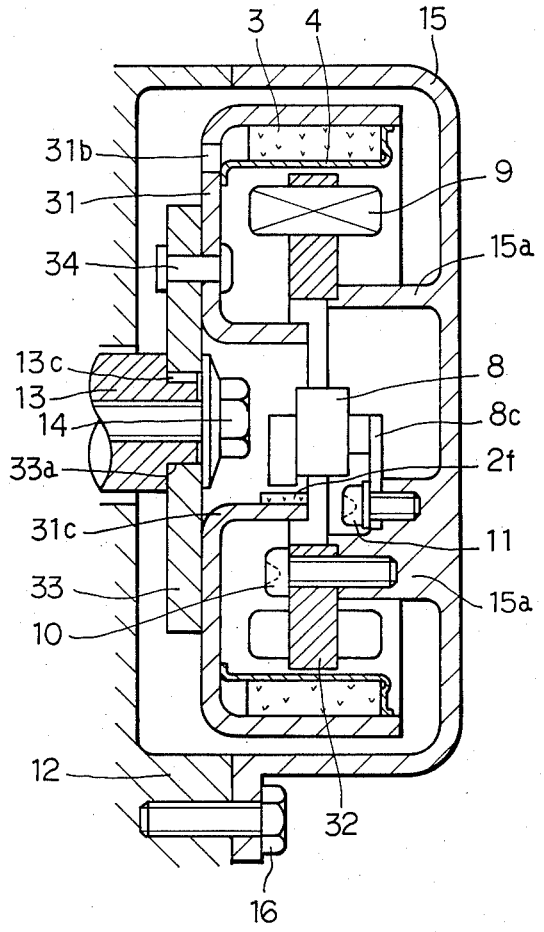
FIG. 16 is a schematic vertical section of a seventh embodiment of the magneto-generator according to the invention.

Instead of providing the second and first iron cups separately as in the sixth embodiment of FIG. 14, a cylindrical portion 31*c* of a diameter large enough for receiving the signal generator 8 may be formed integrally with the first iron cup 31 at the center of its bottom wall by a drawing operation as in the seventh embodiment illustrated in FIG. 16, using the cylindrical portion 13*c* as a second iron cup 2. A retainer 33 is fixed to the bottom surface of the first iron cup 2 by rivets 34, with its splined mounting hole 33*a* fitted on the spline 13*c* of the crankshaft 13, and fixed to the crankshaft 13 by a bolt 14. Further, a magnet 21*f* is securely mounted on the inner periphery of the cylindrical portion 31*c*, in face to face relation with the outer periphery of the protruded end of the signal generator 8. The generator cover 15 of a cup-like shape is provided with an inwardly projecting retainer portion 15*a* integrally on its inner periphery toward the first iron cup 31, securely mounting thereon the stator core 32 and signal generator 8 by screws 10 and 11.

The first iron cup 31 integrally having the cylindrical portion 13*c* as a second iron cup 2 can be easily formed from a single iron sheet by a drawing operation, so that the first and second iron cups 31 and 2 can be fabricated at a lower cost and by a reduced number of steps.

Besides, since the magnet 2*f* is mounted instead of the projection 2*c* which is formed at the open end of the second iron cup 2 in the foregoing embodiments, it is possible to construct the signal generator 8 in a smaller size due to the absence of the built-in magnet and to locate a plural number of signal generators 8 in the cylindrical portion 31*c* if desired. Larger output signal can be obtained by rotating the magnet 2*f* according to rotation of the crankshaft 13 in such a manner that the poles N and S are alternately confront the signal generator 8 by the rotation of the magnet 2*f*. In a case where the magnet 2*f* is mounted in a ring-like form around the inner periphery of the open end of the cylindrical portion 31*c*, it becomes possible to change the signal waveform easily by varying the magnetization pattern of the magnet 2*f*.

Moreover, as the stator core 32 and signal generator 8 are fixedly supported on the retainer portion 15*a* of the generator cover 15, the number of parts of the stator base can be reduced.

Figure 3:
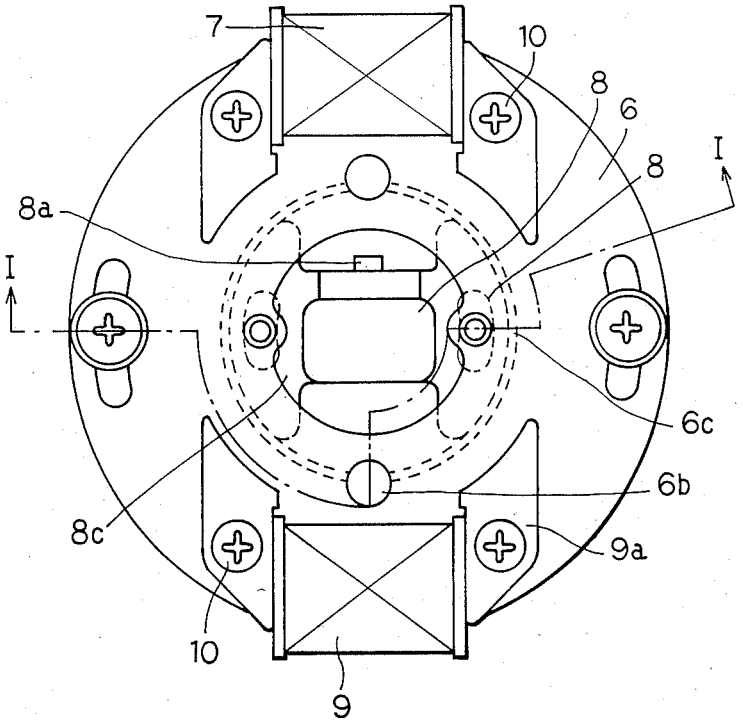
FIG. 3 is a schematic plan view, showing the construction of the stator in the first embodiment.

As seen in FIG. 3, depending upon the positions of the mounting holes of the screws 10 which fix the stator core 32 to the stator base 6, the stator core 32 may become large, making it difficult to reduce the outer diameter of the iron cup 31. In such a case, the mounting holes for the screws 10 may be provided in a plural number of pole projections of the stator core 32 without the power-generating coils 9 for the loads, thereby to reduce the outer diameter of the iron cup 31 and minimize the moment of inertia of the first iron cup 31.

In the case of using a signal generator without a magnet, a small timing hole may be provided in the iron cup 2 instead of fixing a small magnet on its inner periphery, generating output signals in the signal generator by the magnetic flux of the magnets 3 which leaks through the small hole.

Further, the signal generator may be replaced by a magnetic signal generator constituted by a Hall element or a magnetic reluctive element, or a photoelectric signal generator constituted by a photoelectric element, or alternatively a contact type signal generator employing a breaker which is opened and closed by an internal cam surface formed on the inner periphery of the iron cup 2. Needless to say, in the case of a sensorless ignition system which renders the thyristor 23 conductive by negative output of the capacitor-charging oil 7, there is no need for providing the signal generator 8 or the like in the magneto-generator.

For fixation of the magnets 3 to the first and second iron cups 31 and 2, screws may be used in place of an adhesive or the magnet may be secured integrally to the iron cup after anchoring same in aluminum or a synthetic resin material. Otherwise, the pole pieces may be fixed on the outer surfaces of the magnets 3.

Although the iron cup 2 is fastened to the crankshaft 13 by the bolt 14 in foregoing embodiments, it may be fixed to the crankshaft 13 by providing a male screw at the fore end of the crankshaft 13 to be passed through the mounting hole 2*a* of the iron cup 2 and tightening a nut on the male screw portion which is projected into the inner bottom portion of the iron cup 2. In this case, the iron cup 2 is securely fixed on the crankshaft 13 with the nut and male screw portion alone projected into the inner bottom portion of the iron cup 2. Alternatively, a circular reinforcing plate with mounting holes may be fixed to the bottom portion of the iron cup 2 by rivets or the like, fixedly mounting the iron cup 2 on the crankshaft 13 by screws through the reinforcing plate.

Where a bolt 14 is used for fastening the iron cup 2 to the crankshaft 13, there may be employed a bolt with a hexagon socket head for receiving a hexagonal wrench key, instead of a simple hexagonal head.

Although the stator base 6, to which the signal generator 8 is fixed, has been shown as being secured to the generator cover 15 by screws 17*a* from the side of the iron cup 2, it is possible to provide retainer projections which extend radially inward from the generator cover 15 at the end of the stator base 6 on the side of the iron cup 2 and to fix the stator base 6 to the retainer projections by screws from the side of the ignition point adjusting cover 17. In this case, the holes which receive the screws of the stator base 6 are formed in elongated slots so that the stator base 6 may be turned. By so doing, the ignition point can be adjusted simply by turning the stator base 6 after removing the ignition point adjusting cover 17.

What is claimed is:

1. A magneto-generator for an internal combustion engine having a crankshaft, comprising:

an iron cup fixedly mounted on said crankshaft of said internal combustion engine for rotation therewith and having the open end thereof faced outward in a direction away from said crankshaft;

a permanent magnet mounted on the outer periphery of said iron cup for rotation therewith;

a stator core located opposingly to said permanent magnet;

a power-generating coil mounted on said stator core;

a signal generator located substantially centrally in said iron cup and having at least one part thereof located in a position opposing the fore end of said crankshaft; and a timing portion provided on the inner periphery of said iron cup in a position opposing said signal generator.

2. A magneto-generator according to claim 1, wherein said timing portion is in the form of an embossed portion formed integrally with said iron cup by embossing inner peripheral wall thereof.

3. A magneto-generator according to claim 1, wherein said timing portion is in the form of a magnet fixedly mounted on the inner periphery of said iron cup.

4. A magneto-generator according to claim 1, wherein said stator core is I-shaped.

5. A magneto-generator according to claim 1, wherein said stator core is in the form of a ring with a multitude of pole projections extending radially inward directions.

6. A magneto-generator according to claim 1, wherein said stator core is in the form of a ring with a multitude of slots on the side of the inner periphery thereof for receiving said power-generating coil.

7. A magneto-generator according to claim 1, wherein said stator core and said signal generator are fixed on a common base having a hole for receiving part of the fixed side of said signal generator.

8. A magneto-generator according to claim 1, further comprising:

a ring gear is fixed between said iron cup and crankshaft for starting said internal combustion engine.

9. A magneto-generator according to claim 1, wherein said iron cup is provided with a hole in the center of the bottom wall thereof and means for fixedly fitting said hole directly on said crankshaft, said hole having a positioning rugged part in a marginal edge portion thereof.

10. A magneto-generator according to claim 9, wherein said positioning rugged part is spline.

11. A magneto-generator according to claim 9, wherein said positioning rugged part is a tab portion bent toward said crankshaft.

12. A magneto-generator according to claim 9, wherein said means is in the form of a bolt thrusted in said crankshaft.

13. A magneto-generator for internal combustion engine having a crankshaft, comprising:

a first iron cup fixedly mounted on said crankshaft of said internal combustion engine for rotation therewith and having the open end thereof faced outward in a direction away from said crankshaft;

a permanent magnet fixedly mounted on the inner periphery of said first iron cup for rotation therewith;

a stator core located on the inner side of said permanent magnet;

a power-generating coil mounted on said stator core;

a second iron cup located on the inner side of said stator core;

a signal generator located substantially centrally in said second iron cup and having at least one part thereof located in a position opposing the fore end of said crankshaft; and a timing portion provided on the inner periphery of said second iron cup in a position opposing said signal generator.

14. A magneto-generator according to claim 13, wherein said second iron cup is formed separately from said first iron cup and fixedly mounted on said crankshaft integrally with said first iron cup.

15. A magneto-generator according to claim 13, wherein said second iron cup is formed in a cylindrical shape integrally at the center of said first iron cup which fixed to a retainer member to be mounted on said crankshaft.

16. A magneto-generator for internal combustion engine having a crankshaft comprising:

an iron cup mounted on said crankshaft of an internal combustion engine;

a permanent magnet mounted on the outer periphery of said iron cup;

a cup-shaped magnet protection cover fitted around the outer periphery of said permanent magnet; and an annular plate covering an end surface of said permanent magnet of the open side of said cup-shaped magnet protection cover.

17. A magneto-generator according to claim 16, wherein said iron cup, magnet protection cover, permanent magnet and annular plate are securely adhered together by an adhesive.

18. A magneto-generator according to claim 16, wherein said magnet protection cover is fixed to a projection provided on the outer base of said iron cup.

19. A magneto-generator according to claim 16, wherein said plate is retained in position by transforming part of the outer peripheral wall of said iron cup in a radially outward direction.

20. A magneto-generator according to claim 16, wherein said plate has a greater wall thickness than said magnet protection cover, and provided with a bent portion at one part thereof for blocking rotation of said magnet.

21. A magneto-generator according to claim 16, wherein said plate is sandwiched between said iron cup and crankshaft.

22. A magneto-generator for an internal combustion engine having a crankshaft comprising:

an iron cup adapted to be fixedly mounted on said crankshaft of said internal engine for rotation therewith, said cup having an open end outwardly in a direction away from said crankshaft;

a signal generator located substantially centrally in said iron cup and having at least one part thereof located in a position opposing a fore end of said crankshaft;

a timing portion provided on an inner periphery of said iron cup in a position opposing said signal generator;

a permanent magnet arranged at an outside of said iron cup; and a stator core located opposingly to said permanent magnet and having a power-generating coil mounted thereon.

* * * * *